US009936850B2

(12) United States Patent
Becker et al.

(10) Patent No.: US 9,936,850 B2
(45) Date of Patent: Apr. 10, 2018

(54) DISHWASHER WITH CONTROLLED ROTATION OF LOWER SPRAY ARM

(71) Applicant: WHIRLPOOL CORPORATION, Benton Harbor, MI (US)

(72) Inventors: Kevin L. Becker, Holland, MI (US); Nelson J. Ferragut, Saint Joseph, MI (US); Jordan R. Fountain, Millbrae, CA (US); Jonathan D. Gephart, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 227 days.

(21) Appl. No.: 14/966,638

(22) Filed: Dec. 11, 2015

(65) Prior Publication Data

US 2016/0095494 A1 Apr. 7, 2016

Related U.S. Application Data

(62) Division of application No. 13/613,960, filed on Sep. 13, 2012, now Pat. No. 9,220,393.

(51) Int. Cl.

| | |
|---|---|
| ***A47L 15/22*** | (2006.01) |
| ***A47L 15/42*** | (2006.01) |
| ***A47L 15/00*** | (2006.01) |
| *B08B 3/02* | (2006.01) |

(52) U.S. Cl.

CPC ..... *A47L 15/0018* (2013.01); *A47L 15/22* (2013.01); *A47L 15/4219* (2013.01); *A47L 15/4221* (2013.01); *A47L 15/0039* (2013.01); *A47L 15/0057* (2013.01); *A47L 15/4206* (2013.01); *A47L 15/4208* (2013.01); *A47L 2401/14* (2013.01); *A47L 2401/24* (2013.01); *A47L 2501/20* (2013.01); *B08B 3/02* (2013.01)

(58) Field of Classification Search

CPC ..... A47L 15/0018; A47L 15/039; A47L 15/0057; A47L 15/22; A47L 15/4206; A47L 15/4208; A47L 15/4219; A47L 15/4221; A47L 4201/14; A47L 4201/24; A47L 2501/20

See application file for complete search history.

(56) References Cited

U.S. PATENT DOCUMENTS 5,681,401 A * 10/1997 Gardner ..... A47L 15/0049 134/113

FOREIGN PATENT DOCUMENTS

DE 10121083 * 10/2002 ..... A47L 15/42

* cited by examiner

*Primary Examiner* — Saeed T Chaudhry
(74) *Attorney, Agent, or Firm* — McGarry Bair PC

(57) ABSTRACT

A dishwasher for treating dishes according to at least one cycle of operation and methods for operating a dishwasher. The dishwasher may have a tub at least partially defining a treating chamber, a rotatable sprayer, a drive system operably coupled to the rotatable sprayer to effect movement of the rotatable sprayer, and a liquid recirculation system for recirculating sprayed liquid. The dishwasher may have a sump including a sensor enclosure, a first sensor element located within the sensor enclosure and configured to sense at least a portion of the rotatable sprayer, and a controller configured to receive output from the first sensor element and control the drive system and the liquid recirculation system to rotate the rotatable sprayer while selectively supplying liquid to the rotatable sprayer.

14 Claims, 6 Drawing Sheets

DISHWASHER WITH CONTROLLED ROTATION OF LOWER SPRAY ARM

CROSS-REFERENCE TO RELATED APPLICATIONS

The present application represents a divisional application of and claims priority to U.S. patent application Ser. No. 13/613,960 entitled "DISHWASHER WITH CONTROLLED ROTATION OF LOWER SPRAY ARM" filed Sep. 13, 2012, now U.S. Pat. No. 9,220,393 issued Dec. 29, 2015.

BACKGROUND OF THE INVENTION

Contemporary automatic dishwashers for use in a typical household include a tub and upper and lower racks or baskets for supporting soiled dishes within the tub. A spray system and a filter system are provided for re-circulating wash liquid throughout the tub to remove soils from the dishes. The dishwasher may have a controller that implements a number of pre-programmed cycles of operation to wash dishes contained in the tub.

BRIEF DESCRIPTION OF THE INVENTION

An embodiment of the invention relates to a dishwasher for treating dishes according to at least one cycle of operation and having a tub at least partially defining a treating chamber for receiving the dishes, a rotatable sprayer providing a spray of liquid into the treating chamber and defining a rotational path as the rotatable sprayer is rotated, a drive system operably coupled to the rotatable sprayer to effect movement of the rotatable sprayer, a liquid recirculation system defining a recirculation flow path and selectively recirculating the sprayed liquid from the treating chamber to the rotatable sprayer, a sump assembly mounted in a lower portion of the tub and including a sensor enclosure projecting upwardly from a bottom of the sump and terminating in a tip near the rotational path, a first sensor element located within the sensor enclosure and configured to sense at least a portion of the rotatable sprayer during rotation of the rotatable sprayer and outputting a location output related to the location of the first lower spray assembly 24 being sensed, and a controller configured to receive output from the first sensor element and control the drive system and the liquid recirculation system to rotate the rotatable sprayer while selectively supplying liquid to the rotatable sprayer.

Another embodiment of the invention includes a method of operating a dishwasher, the method includes spraying liquid from the rotatable sprayer within a treating chamber, recirculating the sprayed liquid from the treating chamber to sprayers for subsequent spraying to define a recirculation flow path, and controlling the rotation of a rotatable sprayer to linger at a location relative to a filter such that at least a portion of the sprayed liquid is focused on the filter within a single revolution of the rotatable sprayer.

Yet another embodiment of the invention includes a method of operating a dishwasher, the method includes determining a degree of clogging of a filter and automatically controlling the rotation of a rotatable sprayer such that at least a portion of the sprayed liquid is focused on the filter based on the degree of clogging of the filter.

A further embodiment of the invention includes a method of operating a dishwasher, the method includes spraying liquid from a rotatable sprayer within a treating chamber and rotating the rotatable sprayer during a cycle of operation and automatically controlling the rotation of the rotatable sprayer to stop the rotatable sprayer at a location that does not interfere with removal of a filter after a completion of the cycle of operation.

Another embodiment of the invention includes a method of operating a dishwasher where the method includes estimating a rotational position of a rotatable sprayer based on a time it takes for the rotatable spray to rotate through the revolution with a stop at an intermediate stop.

DESCRIPTION OF EMBODIMENTS OF THE INVENTION

Figure 1:
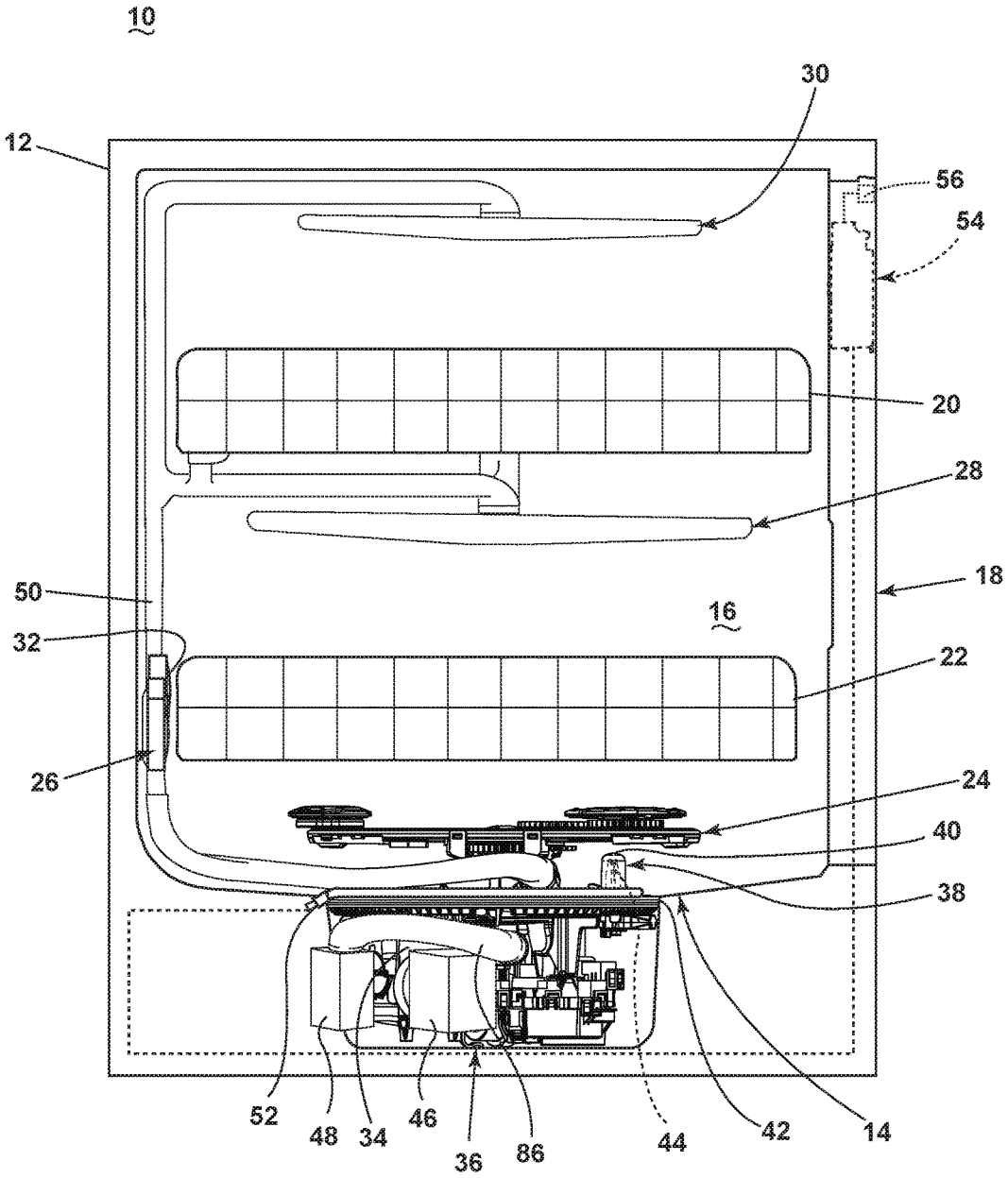
FIG. 1 is a perspective view of a dishwasher in accordance with a first embodiment of the invention.

In FIG. 1, a dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. A tub 14 having an open-face forming an access opening may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 20, 22, are located within the treating chamber 16 and receive dishes for washing. The upper and lower racks 20, 22 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, utensils, plates, pots, bowls, pans, glassware, and silverware.

A spray system is provided for spraying liquid in the treating chamber 16 and includes sprayers provided in the form of a first lower spray assembly 24, a second lower spray assembly 26, a rotating mid-level spray arm assembly 28, and/or an upper spray arm assembly 30, which are proximate to the tub 14 to spray liquid into the treating chamber 16. Upper spray arm assembly 30, mid-level spray arm assembly 28 and lower spray assembly 24 are located, respectively, above the upper rack 20, beneath the upper rack 20, and beneath the lower rack 22 and are illustrated as rotatable sprayers, which each form a rotational path as they rotate. The second lower spray assembly 26 is illustrated as being located adjacent the lower dish rack 22 toward the rear of the treating chamber 16. The second lower spray assembly 26 is illustrated as including a vertically oriented distribution header or spray manifold 32. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for defining a recirculation flow path and selectively recirculating the sprayed liquid from the treating chamber 16 to the spray system. The recirculation system may include a sump assembly 34 and a pump assembly 36. The sump assembly 34 collects the liquid sprayed in the treating chamber 16 and may be formed by a sloped or recessed portion of a bottom wall of the tub 14. The sump assembly 34 is illustrated as being mounted in a lower portion of the tub 14 and includes a sensor enclosure 38. The sensor enclosure 38 projects upwardly from a bottom of the sump assembly 34 and terminates in a tip 40 near the rotational path of the first lower spray assembly 24. More specifically, the sensor enclosure 38 projects upwardly from a bottom of a wall 42 of the sump assembly 34. A first sensor element or sensor 44 may be located within the sensor enclosure 38 and may be configured to sense at least a portion of the first lower spray assembly 24 during rotation of the first lower spray assembly 24 and outputting a signal indicative of the first lower spray assembly 24 being sensed.

The pump assembly 36 has been schematically illustrated as including both a drain pump assembly 46 and a recirculation pump assembly 48. The drain pump assembly 46 may draw liquid from the sump assembly 34 and pump the liquid out of the dishwasher 10 to a household drain line (not shown). The recirculation pump assembly 48 may be fluidly coupled between the treating chamber 16 and the spray system to define a recirculation flow path for circulating the sprayed liquid. More specifically, the recirculation pump assembly 48 may draw liquid from the sump assembly 34 and the liquid may be simultaneously or selectively pumped through a supply tube 50 to each of the assemblies 24, 26, 28, 30 for selective spraying. While not shown, a liquid supply system may include a water supply conduit coupled with a household water supply for supplying water to the treating chamber 16.

A heating system including a heater 52 may be located within the tub 14 for heating the liquid contained in the tub 14.

A controller 54 may also be included in the dishwasher 10, which may be operably coupled with various components of the dishwasher 10 to implement a cycle of operation. The controller 54 may be located within the door 18 as illustrated, or it may alternatively be located somewhere within the chassis 12. The controller 54 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 54 and receive information.

Figure 2:
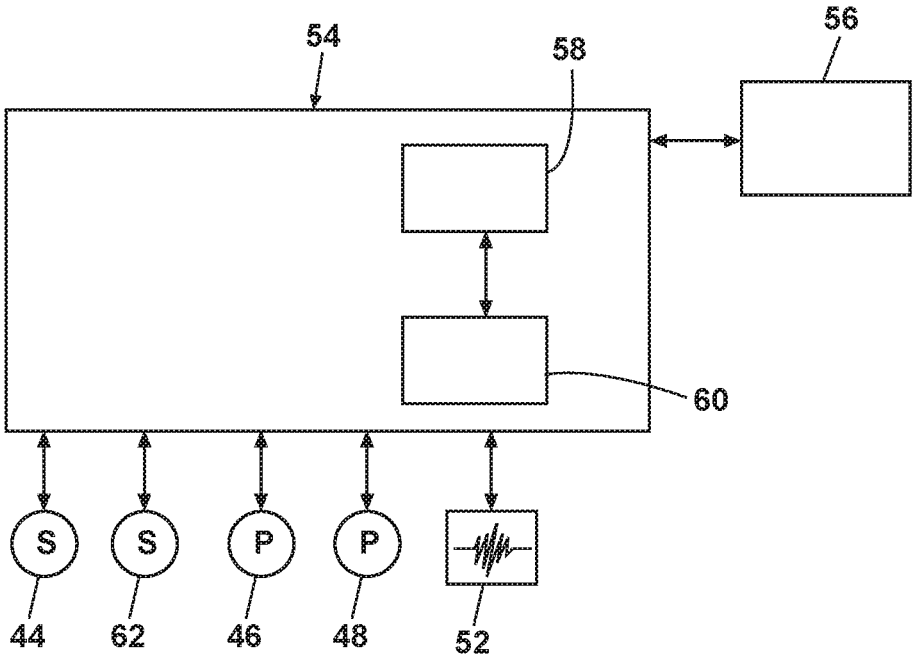
FIG. 2 is a schematic, cross-sectional view of the dishwasher shown in FIG. 1.

As illustrated schematically in FIG. 2, the controller 54 may be coupled with the heater 52 for heating the wash liquid during a cycle of operation, the drain pump assembly 46 for draining liquid from the treating chamber 16, and the recirculation pump assembly 48 for recirculating the wash liquid during the cycle of operation. The controller 54 may be provided with a memory 58 and a central processing unit (CPU) 60. The memory 58 may be used for storing control software that may be executed by the CPU 60 in completing a cycle of operation using the dishwasher 10 and any additional software. For example, the memory 58 may store one or more pre-programmed cycles of operation that may be selected by a user and completed by the dishwasher 10. The controller 54 may also receive input from the sensor 44 and one or more additional sensors 62. Non-limiting examples of additional sensors that may be communicably coupled with the controller 54 include a temperature sensor and turbidity sensor to determine the soil load associated with a selected grouping of dishes, such as the dishes associated with a particular area of the treating chamber.

Figure 3:
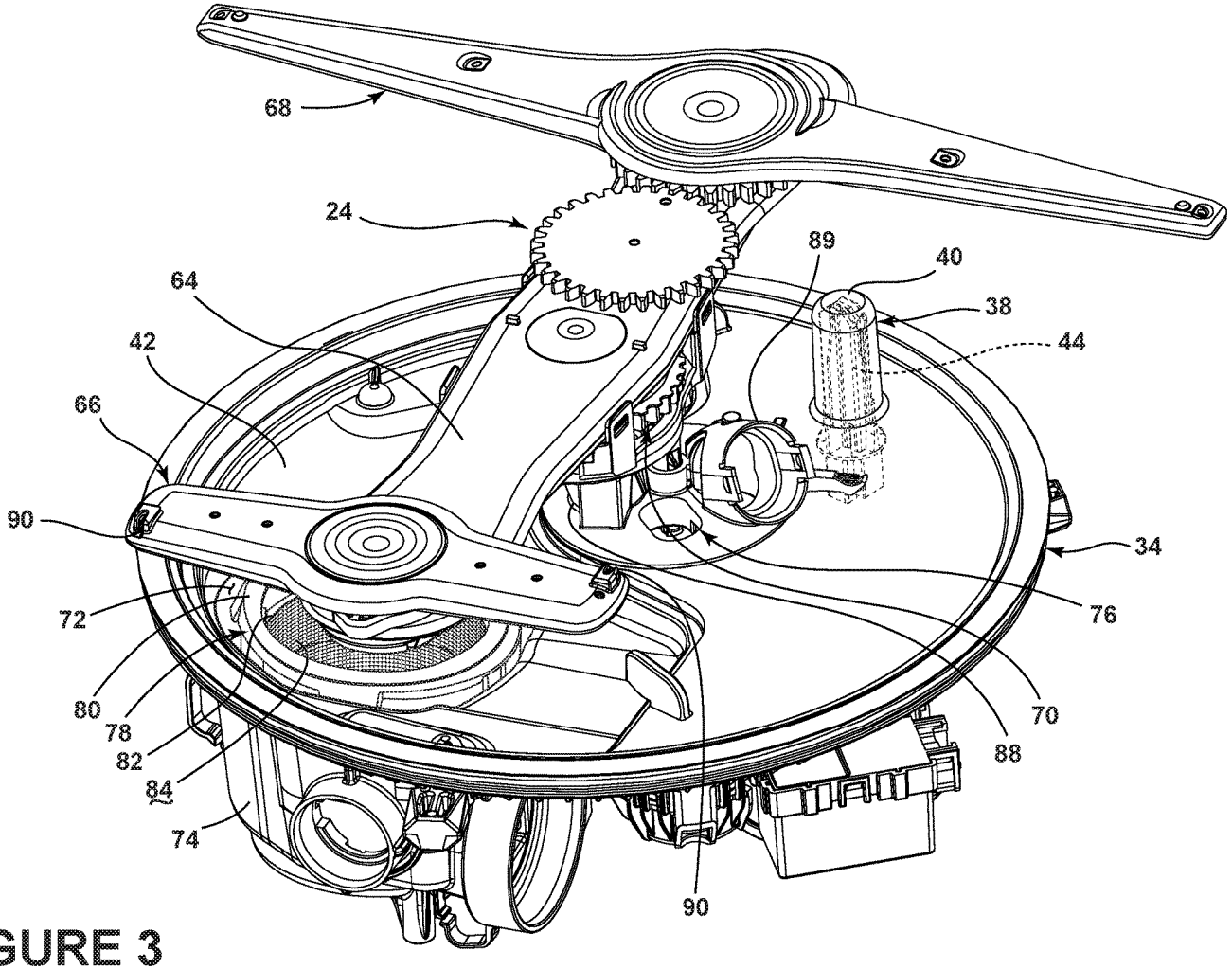
FIG. 3 is a more detailed perspective view of a portion of the dishwasher of FIG. 1 including a sump, a pump assembly, a first lower spray assembly, drive systems, and a valve assembly.

Referring now to FIG. 3, the first lower spray assembly 24 and sump assembly 34 are illustrated in isolation from the rest of the dishwasher 10 for clarity purposes. The first lower spray assembly 24 has been illustrated as including multiple rotating spray arms that are both motor controlled and hydraulically controlled. It will be understood that this is by way of non-limiting example only and that the first lower spray assembly 24 may take a variety of configurations including that of a single rotatable spray arm. In the illustrated embodiment, the first lower spray assembly 24 includes a main spray arm assembly 64 on which is mounted a first auxiliary spray arm 66 and a second auxiliary spray arm 68. A spray assembly drive system 70, for rotating the first lower spray assembly 24 is also partially shown. It will be understood that any suitable first lower spray assembly may be used and that the first lower spray assembly is merely for exemplary purposes.

An inlet 72 may be located in the sump plate 42 and may lead to a sump portion 74 and a lower assembly base 76. The wall 42 may define a portion of a bottom wall of the tub 14. The sump portion 74 may retain liquid sprayed into the treating chamber 16 and may be fluidly coupled to the recirculation pump assembly 48 (FIG. 1). A filter 78 may be located in the sump portion 74 and liquid entering the inlet 72 may travel through the filter 78 before traveling into the remainder of the sump portion 74. The filter 78 may include a projection 80 and a screen filter 82 having passages 84. While fluid is permitted to pass through the screen filter 82, the size of the passages 84 prevents the soil particles of the unfiltered liquid from moving into the remainder of the sump portion 74. As a result, those soil particles may accumulate within the filter 78. The filter 78 may be removed by a user from the sump portion 74 and cleaned such that the soil particles do not accumulate and cover the passages 84 and clog portions of the filter 78 and prevent fluid from passing into the remainder of the sump portion 74.

The lower assembly base 76 may be formed in a portion of the wall 42 and may be fluidly coupled with the sump portion 74 through the recirculation pump assembly 48 and a conduit 86 (FIG. 1). The lower assembly base 76 may include a first fluid conduit 88 fluidly coupled to the first lower spray assembly 24 and a second fluid conduit 89 fluidly coupled with the supply tube 50 (FIG. 1). The first lower spray assembly 24 may be rotatably mounted on the first fluid conduit 88.

Figure 4:
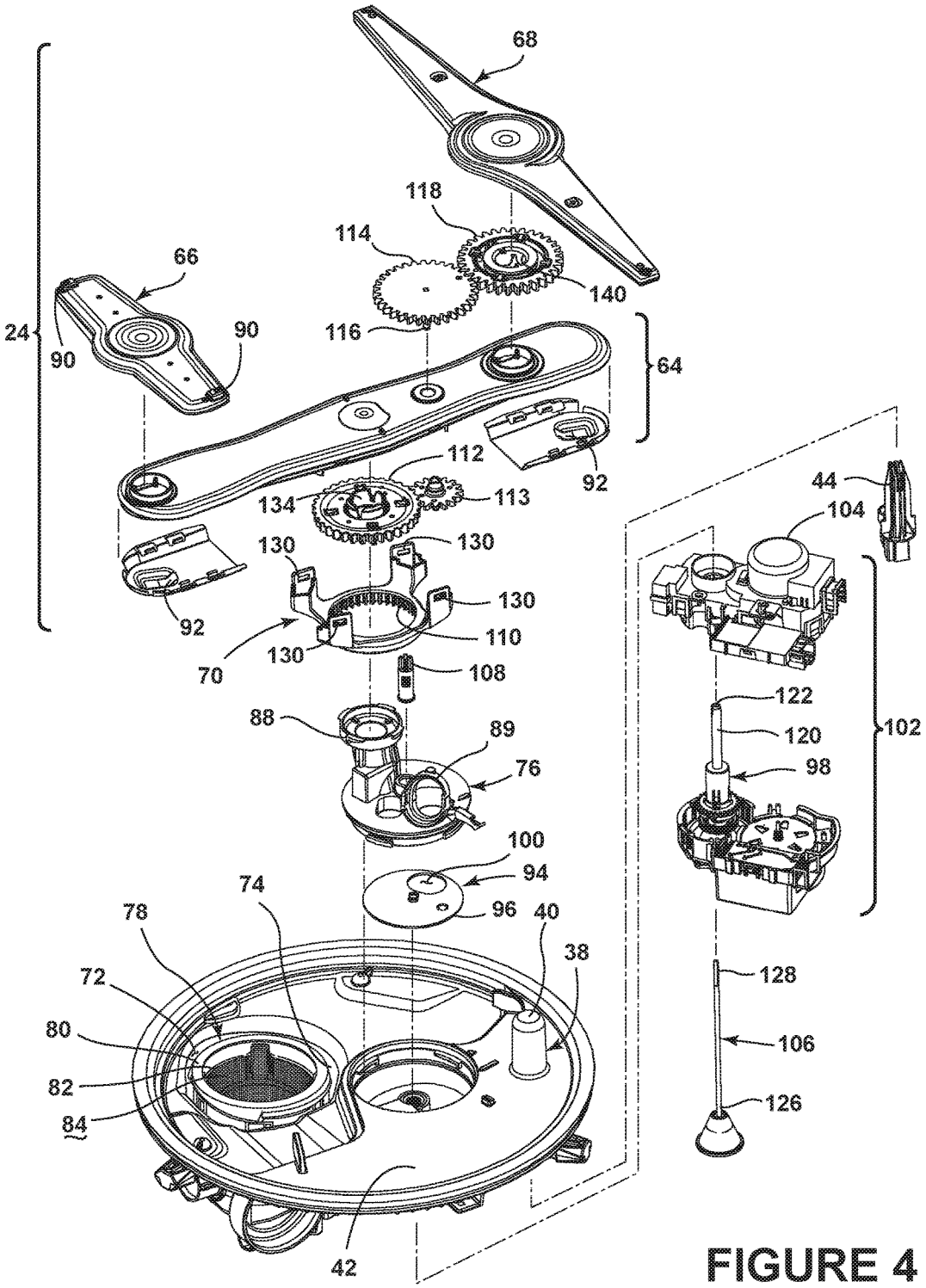
FIG. 4 is an exploded view of the portions of the dishwasher illustrated in FIG. 3.

The details of the sump assembly are shown and described with respect to FIG. 4, which is an exploded view of the sump assembly. For example, the sensor enclosure 38 is more clearly illustrated as projects upwardly from the wall 42. The sensor enclosure 38 may be water tight and may be integrally formed with the sump assembly 34. For example it may be integrally molded with the wall 42 of the sump assembly 34. The sensor enclosure 38 may be open on an end opposite the treating chamber 16 and the sensor 44 may be introduced there through such that the sensor 44 may be located within the sensor enclosure 38. In this manner the sensor 44 may be fluidly isolated from the treating chamber 16. The sensor 44 may be configured to sense at least a portion of the first lower spray assembly 24 during rotation of the first lower spray assembly 24. The sensor 44 may be mounted within the sensor enclosure 38 in any suitable manner including that the sensor 44 may be mounted to a bottom portion of the wall 42. The sensor 44 may be any suitable sensor for determining a presence or location of the first lower spray assembly 24 and configured to output a signal indicative of the first lower spray assembly 24 being sensed to the controller 54. By way of non-limiting example, the sensor 44 may be an optical sensor. It is further contemplated that a second sensor element may be located on a portion of the first lower spray assembly 24. For example, a magnet 45 may be located on the first lower spray assembly 24 and the sensor 44 may senses a magnetic field of the magnet 45. For example, the sensor 44 may be a hall-effect sensor.

It may more clearly be seen that the main spray arm assembly 64 is driven by a spray assembly drive system 70 that also drives the second auxiliary spray arm 68. The first auxiliary spray arm 66 may be hydraulically driven through drive nozzles 90. The main spray arm assembly 64 includes several downward facing nozzles 92, which may be used to spray portions of the sump assembly 34 including the filter 78.

Also illustrated is a diverter valve assembly 94 having a rotatable diverter valve element 96, which may be located within the liquid flow path and may be driven by a valve drive system 98. The diverter valve element 96 is illustrated as a rotatable diverter disk having an opening 100, which may align with one of the first fluid conduit 88 and the second fluid conduit 89 in the lower assembly base 76 to selectively fluidly couple fluid in the sump portion 74 to the various spray assemblies 24-30 when the diverter valve element 96 is rotated to one of the multiple positions. It has been contemplated that the diverter valve element 96 may have one or more opening 100 although only one is illustrated. It is also contemplated that the lower assembly base 76 may have any alternative number of fluid conduits depending upon the configuration of the spray assemblies within the dishwasher 10.

A power unit 102 forms a portion of the valve drive system 98 and the spray assembly drive system 70 and may be operably coupled with the diverter valve element 96 and the main spray arm assembly 64. More specifically, the power unit 102 may be a drive motor 104, which supplies power or driving force to the valve drive system 98 and the spray assembly drive system 70. The drive motor 104 can be located outside the tub 14 (FIG. 1). The spray assembly drive system 70 may include a rotatable drive shaft 106, which may be operably coupled to the drive motor 104 and a gear train comprising a drive gear 108 and an outer ring gear 110. The gear train may couple the rotatable drive shaft 106 to the first lower spray assembly 24 such that rotation of the rotatable drive shaft 106 effects rotation of the first lower spray assembly 24 via the gear train. It is contemplated that a gear ratio of the gear train is such that the rotatable drive shaft 106 and first lower spray assembly 24 rotate at different speeds. For example, the gear ratio may be such that the first lower spray assembly 24 slower than the rotatable drive shaft 106. A support gear 112, several intermediate gears 113 and 114, a transfer shaft 116, and an output gear 118 may also be included in the spray assembly drive system 70. The valve drive system 98 may include a rotatable drive shaft 120 operably coupled between the drive motor 104 and the diverter valve element 96. The rotatable drive shaft 120 may use the power from the drive motor 104 to drive the rotation of the diverter valve element 96.

Figure 5:
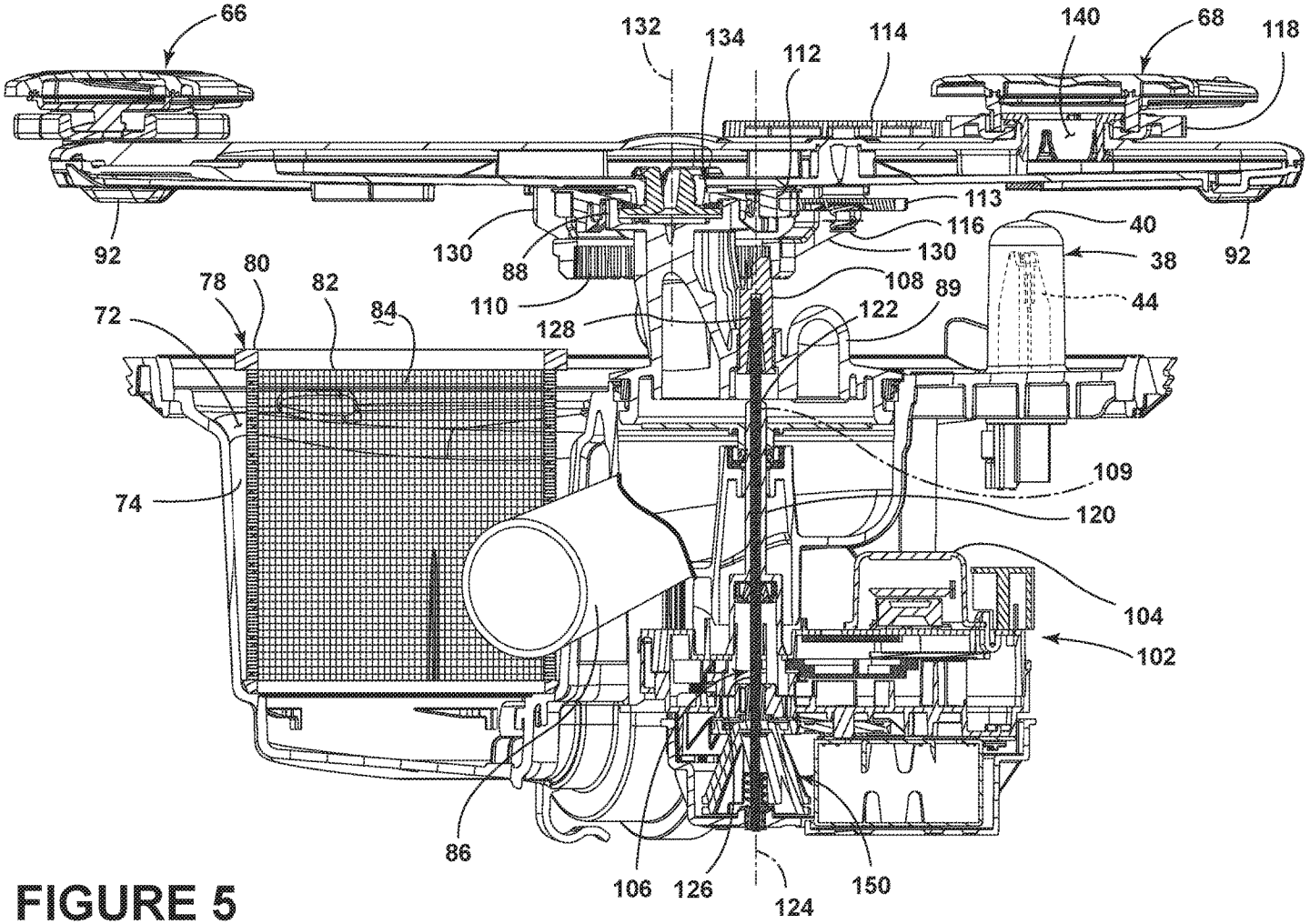
FIG. 5 is a cross-sectional view of the portion of the dishwasher illustrated in FIG. 3.

Referring to FIG. 5, the diverter valve element 96 may be rotated about an axis of rotation 109 by the valve drive system 98 between multiple positions to selectively divert liquid flowing from the sump portion 74 between the spray assemblies 24-30. The opening 100 allows wash water to flow through the lower assembly base 76 and into one of the four spray assemblies 24-30 (FIG. 1). Thus, movement of the diverter valve element 96 between its multiple positions allows selective fluid coupling of the wash liquid in the sump portion 74 and the various spray assemblies 24-30.

The rotatable drive shaft 120 is illustrated as having a central opening 122 for passage of the rotatable drive shaft 106. The rotatable drive shaft 106 may be received within the central opening 122 of the rotatable drive shaft 120 such that it is free to rotate within the central opening 122 about a second axis of rotation 124. In this manner, the rotatable drive shaft 120 functions as a sleeve to the rotatable drive shaft 106. As illustrated, the first axis of rotation 109 and the second axis of rotation 124 are coaxial to partially integrate the diverter valve assembly 94 and the spray assembly drive system 70 to provide a compact configuration, which may result in a larger usable space in the dishwasher 10 for other components.

The rotatable drive shaft 106 has a lower portion 126, which may be operably coupled to the drive motor 104 such that rotation of the drive motor 104 will rotate the rotatable drive shaft 106. The drive motor 104 may operate to rotate the rotatable drive shaft 106 independently of the movement of the rotatable drive shaft 120. Further, the drive motor 104 may be able to operate in both a forward and reverse direction.

The rotatable drive shaft 106 has an upper portion 128 that extends through the central opening 122 of the rotatable drive shaft 120, through the wall 42 and into the lower portion of the tub 14. The upper portion 128 may be operably coupled to the drive gear 108. The drive gear 108 may in turn be enmeshed with the outer ring gear 110. The outer ring gear 110 may have one or more upwardly extending supports 130 that may be operably coupled to the main spray arm assembly 64 such that rotational movement of the outer ring gear 110 and the supports 130 may be transferred to the main spray arm assembly 64 to rotate the main spray arm assembly 64. The main spray arm assembly 64 may rotate about a third axis of rotation 132. The first fluid conduit 88 may also be aligned with this third axis of rotation 132 to provide a compact configuration.

Looking at the spray assembly drive system 70 in more detail, the rotatable drive shaft 106 rotates about the second axis of rotation 124, which is offset from an axis of rotation 132 of the first lower spray assembly 24. As the rotatable drive shaft 106 is rotated, the drive gear 108 is rotated. The rotational motion of the drive gear 108 causes the outer ring gear 110 to rotate. The outer ring gear 110 is constrained from rotating eccentrically by the first fluid conduit 88 and instead rotates about a third axis of rotation 132. The first lower spray assembly 24, which is operably coupled with the outer ring gear 110 through the supports 130 rotates with the outer ring gear 110. As one entire rotation of the drive gear 108 only completes a partial rotation of the outer ring gear 110, the RPM of the first lower spray assembly 24 is reduced compared to the output RPM of the drive motor 104. Although the gear train shown has a drive and outer ring gear 108 and 110, it has been contemplated that other types of gear assemblies could be used.

The support gear 112 may be operably coupled to the outer ring gear 110 and has been illustrated as including a fluid passageway 134, which may provide fluidly communication between the first fluid conduit 88 and the first lower spray assembly 24. Alternatively, the support gear 112, outer ring gear 110 and the supports 130 may be formed from a single piece. When the spray assembly drive system 70 is assembled, the support gear 112 enmeshes with the intermediate gear 113, which may be located on the underside of the main spray arm assembly 64. The transfer shaft 116 may operably couple the intermediate gear 113 with the intermediate gear 114, which may be located on an upper side of the main spray arm assembly 64. The intermediate gear 114 may enmesh with the output gear 118, which may be operably coupled to the second auxiliary spray arm 68. It has been contemplated that other types of gear assemblies could be used. As illustrated, the output gear 118 may include a fluid passageway 140 which may provide fluidly communication between the main spray arm assembly 64 and the second auxiliary spray arm 68.

A clutch assembly 150 may be provided and both the rotatable drive shaft 120 and rotatable drive shaft 106 may be selectively operably coupled to the drive motor 104 by the clutch assembly 150. The clutch assembly 150 may be operably coupled to the controller 54 and the controller 54 may actuate and de-actuate the clutch assembly 150 to affect the coupling and uncoupling of the rotatable drive shaft 106 and rotatable drive shaft 120 with the drive motor 104. The clutch assembly 150 may be actuated such that the rotatable drive shaft 106 is coupled together with the drive motor 104 or such that the rotatable drive shaft 120 is coupled together with the drive motor 104. Alternatively, both the rotatable drive shaft 106 and the rotatable drive shaft 120 may be coupled, by the clutch assembly 150, with the drive motor 104 such that drive motor 104 will rotate both the rotatable drive shaft 106 and the rotatable drive shaft 120. Further, it has also been contemplated that instead of using the clutch assembly 150, a separate drive unit or motor may be operably coupled to the rotatable drive shaft 120 and may operate to rotate the rotatable drive shaft 120 independently of the movement of the rotatable drive shaft 106. In that manner, the rotatable drive shaft 106 and rotatable drive shaft 120 could also be independently rotatable. Alternatively, the clutch assembly 150 may affect the coupling of only one of the rotatable drive shaft 106 and rotatable drive shaft 120 while the other may be permanently driven by the motor 104. For example, the rotatable drive shaft 120 may always be coupled to the drive motor 104 and only the rotatable drive shaft 106 may be coupled and uncoupled to the motor by the clutch assembly 150.

Figure 6:
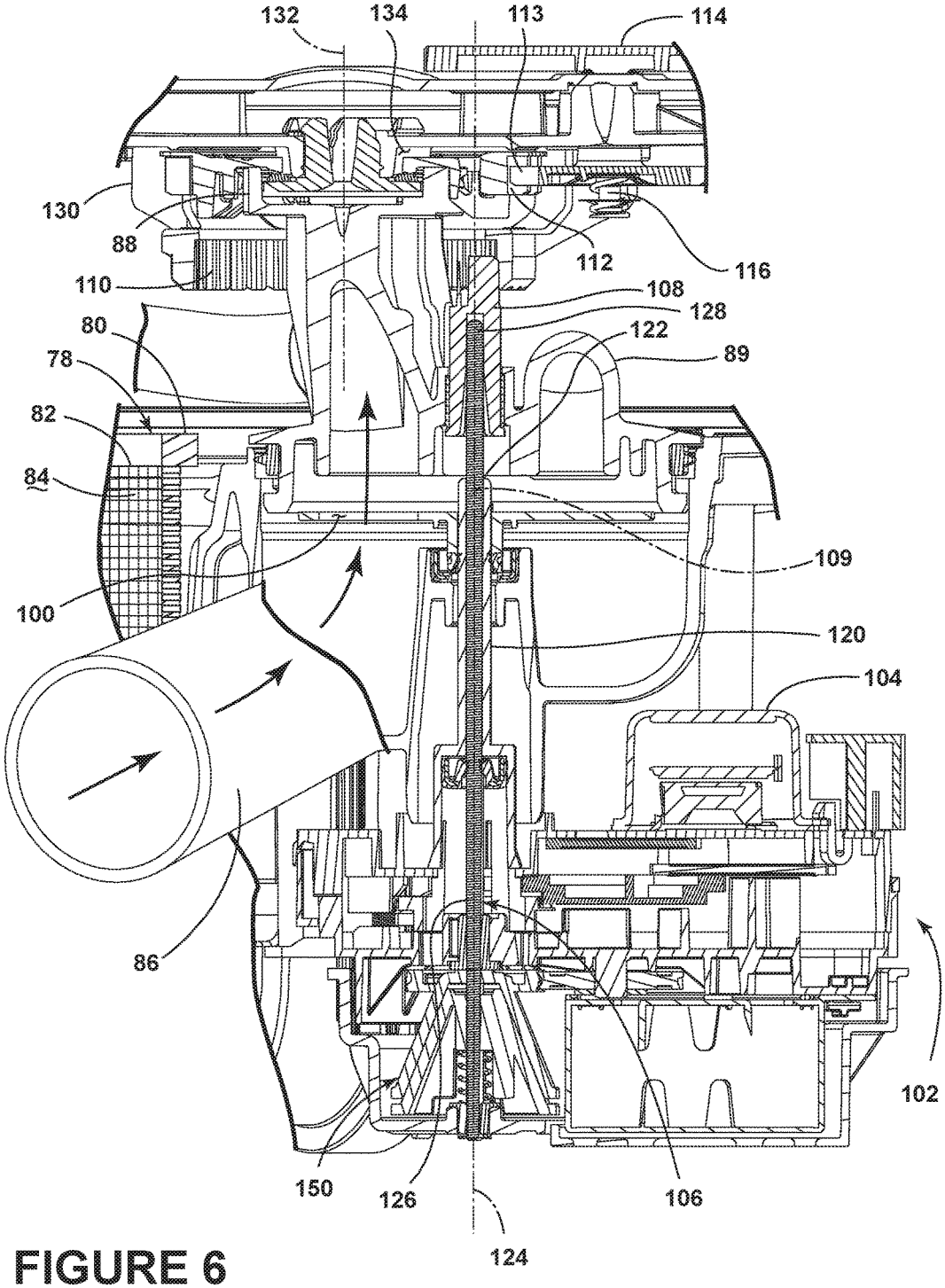
FIG. 6 is a close-up cross-sectional view of the portion of the dishwasher illustrated in FIG. 3.

As shown in FIG. 6, when the diverter valve assembly 94 is assembled, it provides for a fluid path, as shown by the arrows, from the sump assembly 34 to at least one of the spray assemblies 24-30. The fluid path is formed by the opening 100 in the diverter valve element 96, and either the first fluid conduit 88 or the second fluid conduit 89. The movement of the opening 100 relative to the first fluid conduit 88 and the second fluid conduit 89 fluidly connects the sump portion 74, which is connected through the recirculation pump assembly 48, conduit 86, and one of the first fluid conduit 88 and the second fluid conduit 89 to one or more of the spray assemblies 24-30.

During operation of the dishwasher 10, the controller 54 may be employed to control the spray assembly drive system 70, the liquid recirculation system, and the diverter valve element 96 to rotate the first lower spray assembly 24 while selectively supplying liquid to the first lower spray assembly 24. The controller 54 may be employed to control the operation of the drive motor 104 and the clutch assembly 150 to rotate the rotatable drive shaft 106 and/or the rotatable drive shaft 120. If both the rotatable drive shaft 120 and rotatable drive shaft 106 are coupled with the drive motor 104 when the drive motor 104 is operated, both the rotatable drive shaft 106 and the rotatable drive shaft 120 will rotate. As the rotatable drive shaft 120 rotates it effects rotation of the diverter valve element 96. Movement of the rotatable diverter valve element 96 rotates the opening 100 to fluidly connect the inlet 72 with one of the first fluid conduit 88 and the second fluid conduit 89 in the lower assembly base 76 to selectively fluidly couple fluid in the sump portion 74 to the various spray assemblies 24-30 when the diverter valve element 96 is rotated to one of the multiple positions. The amount of time that the opening 100 is fluidly connected with each of the first fluid conduit 88 and the second fluid conduit 89 controls the duration of time that each of the various spray assemblies 24-30 sprays liquid. After achieving the desired fluid coupling of one or more spray assemblies 24-30 with the recirculation pump assembly 48, the drive motor 104 may be deactivated or the rotatable drive shaft 120 may be uncoupled from the motor 104 so that fluid coupling may be maintained, or may be continued to rotate the rotatable drive shaft 120 such that each of the spray assemblies 24-30 is sequentially coupled with the sump assembly 34. It should be noted that the supply tube 50 may feed water to the second lower spray assembly 26, the rotating mid-level spray assembly 28, and the upper spray assembly 30. Thus, additional valving (not shown) may be included to divert water to one of the spray assemblies 26-30. Alternatively, a portion of the wash liquid from the supply tube 50 may go to each of the spray assemblies 26-30. When liquid is directed through the first fluid conduit 88 fluidly to the first lower spray assembly 24, the liquid may cause the first auxiliary spray arm 66 to be hydraulically rotated regardless of the rotation of the remainder of the first lower spray assembly 24.

The rotatable drive shaft 106 may also be rotated by the motor 104 and its movement is transferred through the drive gear 108 to the outer ring gear 110, the support gear 112, and the supports 130, which in turn causes the main spray arm assembly 64 to rotate. The drive gear 108 and outer ring gear 110 form a gear train, which couples the rotatable drive shaft 106 to the main spray arm assembly 64 such that rotation of the rotatable drive shaft 106 about the second axis or rotation 124 effects rotation of main spray arm assembly 64 about the third axis of rotation 132 via the gear train. The movement of the support gear 112 causes movement of the intermediate gear 113, the transfer shaft 116, the intermediate gear 114, and the output gear 118, which in turn causes the second auxiliary spray arm 68 to rotate. The drive motor 104 and other components of the spray assembly drive system 70 may be able to operate in both a forward and reverse direction; thus, the main spray arm assembly 64 and the second auxiliary spray arm 68 may be driven in both a first rotational direction and in a second rotational direction opposite from the first rotational direction. This bi-directional rotation may help to clean utensils in the lower rack 22 and clean the filter 78. The controller 54 may control the time the drive motor 104 is operated in each direction. Further, the controller 54 may operate the drive motor 104 to slow or even stop the main spray arm assembly 64 and the second auxiliary spray arm 68. Slowing or stopping the rotation of the main spray arm assembly 64 and the second auxiliary spray arm 68 may allow for better cleaning in certain areas of the treating chamber 16. During this time, the controller 54 may also operate the recirculation pump assembly 48 to deliver liquid to one or more of the spray arm assemblies 24-30. Thus, the rotation of the first lower spray assembly 24 may be stopped while the recirculation pump assembly 48 is delivering liquid to the first lower spray assembly 24.

In this manner zone spraying may be accomplished and the zone in which the first lower spray assembly 24 is spraying can be adjusted to cover any particular area of the dishwasher. It is contemplated that the customer may be able to select an area of the dishwasher by inputting on the user interface where heavily soiled dishes are. Such a user interface and zonal washing is set forth in detail in U.S. patent application Ser. No. 12/851,628, filed Aug. 6, 2010, and titled "Method for Controlling Zonal Washing in a Dishwasher," which is incorporated herein by reference in its entirety. The cycle can then use the controlled first lower spray assembly 24 to concentrate more liquid in the area selected by the user. The dishwasher 10 may also determine where heavily soiled dishes are by controlling where the first lower spray assembly 24 is spraying and then measuring the soil level through a sensor such as a turbidity sensor.

The dishwasher 10 may be operated in a variety of manners to obtain a variety of benefits. Including that, in one embodiment, the dishwasher 10 may be operated in accordance with a method to have a focused spray on the filter 78. More specifically, the method of operation may include spraying liquid from the first lower spray assembly 24 within the treating chamber 16, recirculating the sprayed liquid by the recirculation pump assembly 48 such that the liquid is recirculated from the treating chamber 16 to the spray system for subsequent spraying. Further, the rotation of the first lower spray assembly 24 may be controlled by the controller 54 such that the first lower spray assembly 24 lingers at a location relative to the filter 78 such that at least a portion of the sprayed liquid is focused on the filter 78 within a single revolution of the first lower spray assembly 24. More specifically, liquid from the downward facing nozzles 92 of the first lower spray assembly 24 are focused on to the filter 78 within a single revolution of the first lower spray assembly 24. Controlling the rotation of the first lower spray assembly 24 may include the controller 54 operating the spray assembly drive system 70, which effects movement of the first lower spray assembly 24 including the main spray arm assembly 64 having the downward facing nozzles 92.

More specifically, the controller 54 may cause the first lower spray assembly 24 to linger such that it hovers over the location relative to the filter 78 within the single revolution of the first lower spray assembly 24. Alternatively, the controller 54 may causer the first lower spray assembly 24 to linger such that it oscillates over the location relative to the filter 78 within the single revolution of the first lower spray assembly 24. This may include oscillating between two predetermined rotational positions between which lie the filter 78. Further still, the controller 54 may cause the first lower spray assembly 24 to linger such that it is fixed above the location relative to the filter 78 within the single revolution of the first lower spray assembly 24. Any of the above examples would focus the spray from the downward facing nozzles 92 onto the filter 78.

The dishwasher 10 may also be operated in accordance with a method to automatically control the rotation of the first lower spray assembly 24 to spray the filter 78 based on a degree of clogging of the filter 78. More specifically, the dishwasher 10 may be operated to spray liquid from the first lower spray assembly 24 within the treating chamber 16 and the sprayed liquid may be recirculated by the recirculation pump assembly 48 from the treating chamber 16 to the first lower spray assembly 24 for subsequent spraying to define a recirculation flow path. The controller 54 may determine a degree of clogging of the filter 78 and may automatically control the rotation of the first lower spray assembly 24 such that at least a portion of the sprayed liquid from the downward facing nozzles 92 is focused on the filter 78 based on the degree of clogging of the filter 78.

Determining the degree of clogging of the filter 78 may be done in any suitable manner. For example, the degree of clogging of the filter 78 may include determining a pressure output of the recirculation pump assembly 48. For example, a pressure sensor may be capable of providing an output indicative of the pressure of the liquid output by the recirculation pump assembly 48. Alternative clogging sensors may be used for determining a degree of clogging may include a motor torque sensor, flow meter, etc. While the liquid is being recirculated, the filter 78 may begin to clog with soil particles. This clogging causes the outlet pressure from the recirculation pump assembly 48 to decrease as the clogging of the passages of the filter 78 hinders the movement of the liquid into an inlet of the recirculation pump assembly 48. The decrease in the liquid movement into the recirculation pump assembly 48 may cause an increase in the motor torque. The decrease in the liquid movement into the recirculation pump assembly 48 may also cause an increase in the speed of the impeller of the recirculation pump assembly 48 as the recirculation pump assembly 48 attempts to maintain the same liquid output.

The signal from the sensor may be monitored by the controller 54 and the controller 54 may determine that when the magnitude of the signal satisfies a predetermined threshold there is a particular degree of clogging of the filter 78. The predetermined threshold for the signal magnitude may be selected in light of the characteristics of any given machine. For the purposes of this description, satisfying a predetermined threshold value means that the parameter, in this case the magnitude of the signal, is compared with a reference value and the comparison indicates the satisfying of the sought after condition, in this case the clogging of the filter 78. Reference values are easily selected or numerically modified such that any typical comparison can be substituted (greater than, less than, equal to, not equal to, etc.). The form of the reference value and the magnitude signal value may also be similarly selected, such as by using an average, a maximum, etc. The controller 54 may also compare the magnitude of the sensor signal to multiple references values to determine the degree of clogging. The controller 54 may also determine the degree of clogging by determining a change in the monitored signal over time as such a determined change may also be illustrative of a degree of clogging of the filter 78. For example, this may include determining a change in a pressure output of the recirculation pump assembly 48. For purposes of this description, it is only necessary that some form of a sensor signal to be compared to at least one reference value in such a way that a determination can be made about the degree of clogging of the filter 78.

Once the controller 54 has determined that a degree of clogging exists, the controller 54 may automatically move the first lower spray assembly 24 relative to the rotating filter 78 to spray the filter 78 with liquid from the downward facing nozzles 92 based on the degree of clogging of the filter 78. To do this, the controller 54 may control the rotation of the first lower spray assembly 24 to linger at a location relative to the filter 78 such that at least a portion of the sprayed liquid is focused on the filter 78 within a single revolution of the first lower spray assembly 24. Controlling the rotation of the first lower spray assembly 24 to linger at a location relative to the filter 78 may include hovering over the location within a single revolution of the first lower spray assembly 24, being fixed above the location within a single revolution of the first lower spray assembly 24, oscillating over the location within a single revolution of the first lower spray assembly 24, etc. All of these may be determined based on the estimated position of the first lower spray assembly 24. For example, oscillating over the location may include oscillating between two predetermined rotational positions between which lie the filter 78 and the determined movement of the first lower spray assembly 24 between the two positions may be based on the estimated position of the first lower spray assembly 24 as explained in more detail below. The controller 54 may operate the spray assembly drive system 70 to effect movement of the first lower spray assembly 24 in one of the above manners based on its estimated position.

The dishwasher 10 may also be operated in accordance with a method to automatically control the rotation of the first lower spray assembly 24 to stop it at a location that will not interfere with removal of the filter 78, which may be referred to as "parking" the arm. More specifically, during a cycle of operation the dishwasher 10 may be operated to spray liquid from the first lower spray assembly 24 within the treating chamber 16 and the first lower spray assembly 24 may be rotated. The rotation of the first lower spray assembly 24 may be automatically controlled by the controller 54 to stop the first lower spray assembly 24 at a location that does not interfere with removal of the filter 78 after a completion of the cycle of operation. For example, automatically controlling the rotation of the first lower spray assembly 24 may include the controller 54 automatically operating the spray assembly drive system 70 to effect movement of the first lower spray assembly 24 to stop the first lower spray assembly 24 at the location, which will not interfere with the removal of the filter 78.

This may include stopping the first lower spray assembly 24 at a location where the first lower spray assembly 24 is radially exterior of the projection 80 of the filter 78. For example, the first lower spray assembly 24 may be stopped on a side of the projection 80 opposite the opening to the treating chamber 16. It is contemplated that the location that does not interfere with the removal of the filter 78 may be a predetermined location. For example, when the first lower spray assembly 24 may be stopped at the predetermined location no portion of the first lower spray assembly 24 is above the filter 78. Further, when the first lower spray assembly 24 is stopped at the predetermined location it is contemplated that no portion of the first lower spray assembly 24 is between an access opening for the treating chamber 16 and the filter 78.

As illustrated, the first lower spray assembly 24 includes multiple rotating spray arms and it is contemplated that when the first lower spray assembly 24 is stopped at the predetermined location no portion of the multiple rotating spray arms forming the first lower spray assembly 24 is between the access opening for the treating chamber 16 and the filter 78. Alternatively, the first lower spray assembly 24 may include a single rotatable arm.

For all of the above methods of operation it is contemplated that, a rotational position of the first lower spray assembly 24 may be estimated based on output from the sensor 44, which outputs a location related to the location of the first lower spray assembly 24. More specifically, the controller 54 may be configured to calculate the location of the first lower spray assembly 24 based on the output from the sensor 44. The spray assembly drive system 70 may then be controlled based on the estimated rotational position of the first lower spray assembly 24. More specifically, the spray assembly drive system 70 may be controlled to stop the rotation of the first lower spray assembly 24 when the location of the first lower spray assembly 24 is estimated to be over a desired target position, such as the location of the filter 78 or a location that does not interfere with removal of the filter. Alternatively, the spray assembly drive system 70 is controlled to oscillate the rotation of the first lower spray assembly 24 when the location of the first lower spray assembly 24 is estimated to be over the location of the filter 78.

In this manner, it will be understood that the dishwasher 10 may be operated in accordance with a method to estimate a rotational position of the first lower spray assembly 24. More specifically, during a cycle of operation, the dishwasher 10 may be operated to control the spray assembly drive system 70 to rotate the first lower spray assembly 24 through a revolution that begins and ends at a predetermined position. This may include determining a location of the first lower spray assembly 24, such as through the use of the sensor 44 and then controlling the spray assembly drive system 70. The location of first lower spray assembly 24 may be determined by passing the first lower spray assembly 24 over the sensor 44, which may also be known as the home position of the first lower spray assembly 24 and then determining its position based on time.

Rotating the first lower spray assembly 24 through the revolution may include stopping the first lower spray assembly 24 at an intermediate stop before completion of the revolution followed by further rotation of the first lower spray assembly 24 to complete the revolution. More specifically, the sensor 44 may mark a home location of the first lower spray assembly 24 and the first lower spray assembly 24 may pass through this home location, the rotation of the first lower spray assembly 24 may be stopped, and the rotation of the first lower spray assembly 24 may be continued until it reaches the home location. The intermediate stop may be located at any point within the complete revolution and the controller 54 may determine a time it takes for the rotatable spray to rotate through the revolution with the stop at the intermediate stop. The controller 54 may then compare the time it takes the first lower spray assembly 24 to rotate through the revolution with the stop at the intermediate stop to a threshold value and estimate a rotational position of the first lower spray assembly 24 based on the comparison.

The threshold value may include a time it takes for the first lower spray assembly 24 to rotate through one revolution at a steady-state. Such a threshold value may be determined by the controller 54. For example, the controller 54 may control the spray assembly drive system 70 to rotate the first lower spray assembly 24 through a revolution that begins and ends at a predetermined position to determine the threshold value. For example, the first lower spray assembly 24 may be rotated from the home position through a full revolution back to the home position. It is contemplated that the controller 54 may estimate an acceleration and deceleration profile of the first lower spray assembly 24 based on the comparison. Such methods to estimate a rotational position of the first lower spray assembly 24 allow for the position of the first lower spray assembly 24 to be accurately determined without the need for multiple sensors that indicate the location of the first lower spray assembly 24 at any particular moment in time.

It is also contemplated that such a method may occur in a different order. For example, once the controller 54 has determined the time that it takes to make a revolution, the controller 54 may use that time increment to estimate the location of the first lower spray assembly 24 relative to the home position. To enhance the accuracy of this estimation, the controller 54 may stop the first lower spray assembly 24 during one revolution, and compare the revolution time with a non-stopped revolution time. From this the controller 54 may determine a value of the deceleration rate or deceleration time, which the controller 54 may then use to determine where the first lower spray assembly 24 will stop during operation. In this manner, if it is known for the arm to take one full revolution in 45 seconds and it takes 3 seconds to come to a stop, then to stop the first lower spray assembly 24 at the desired location, the controller 54 determines the time value corresponding to the desired stop location, then back tracks from that the 3 seconds the first lower spray assembly 24 takes to come to a stop and stops the first lower spray assembly 24 at that point.

Traditional dishwasher spray arms rely on diverted wash water to provide hydraulic drive to rotate wash arms. This hydraulic drive is dependent on pump flow rate and pressure, and the wash arms may only be designed to run at nominal speeds for any given pump. These hydraulically-driven wash arms are also only uni-directional. Further, hydraulically operated spray arms change water flow, pressure, and RPM when the recirculation pump motor speed is changed. It is not uncommon for hydraulically-driven spray arms to stall during portions of a cycle of operation, which may negatively impact cleaning performance. The embodiments of the invention described above allow the lower spray assembly to be motor-driven, resulting in a more efficient method of driving the lower spray assembly, as well as permitting more control over its rotational speed and direction. With the motor driven spray arm, the recirculation pump motor speed can be adjusted for optimum water flow and pressure for the wash performance needed, without affecting the spray arm speed or worrying about the spray arm stalling from the pressure being too low. Many useful spray strategies can be adopted when the position of the lower spray assembly is controlled independently of the supply of liquid through the lower spray assembly. For example, the lower spray assembly may be stopped or slowed at locations where a greater spraying is desired, such as when the lower spray assembly is directed to the corners of the rack or areas having high soil amounts. This allows additional features, such as zonal washing, to be added to the wash cycle and the dishwasher. The ability to manipulate both the speed of rotation of the lower spray assembly and the ability to reverse the direction of the lower spray assembly results in improved wash coverage.

The embodiments of the invention described above also allow a sensor element to be located in a sensor enclosure projecting from the sump. This allows the sensor element to be very close to the rotating spray arm so that it may accurately determine the position of spray arm. The dishwasher may then be more accurately controlled based on the determined position of the spray arm. The sensor enclosure and first sensor element may be re-positioned at a different location, allowing the feature to be used in multiple different dishwasher platforms. The controller merely needs to be told where the sensor is located such that the controller may then control the spray arm with respect to wash zones and a location of the filter.

Embodiments of the invention described above also allow the rotatable sprayer to linger at a location relative to a filter such that at least a portion of the sprayed liquid is focused on the filter within a single revolution of the rotatable sprayer. Embodiments of the invention also allow the rotation of a rotatable sprayer to be automatically controlled such that at least a portion of the sprayed liquid is focused on the filter based on the degree of clogging of the filter allowing the spray arm to clean the filter.

Embodiments of the invention also allow the estimation a rotational position of the rotatable sprayer based on a time it takes for the rotatable spray to rotate through the revolution with a stop at an intermediate stop. All of the above avoid wasted sprays of water and saves both time and energy. Embodiments of the invention also allow the rotatable sprayer to be automatically controlled such that it stops at a location that does not interfere with removal of a filter after a completion of the cycle of operation. Otherwise, the geared spray arm may block the removal of the filter. This further provides for ease of use of the dishwasher and increased customer satisfaction.

While the invention has been specifically described in connection with certain specific embodiments thereof, it is to be understood that this is by way of illustration and not of limitation, and the scope of the appended claims should be construed as broadly as the prior art will permit. Reasonable variation and modification are possible within the scope of the forgoing disclosure and drawings without departing from the spirit of the invention which is defined in the appended claims. For example, it has been contemplated that the invention may differ from the configuration shown in FIGS. 1-6, such as by inclusion of other conduits, utensil racks, valves, spray assemblies, seals, and the like, to control the flow of wash liquid. Further, it will be understood that any features of the above described embodiments may be combined in any manner.

What is claimed is:

1. A dishwasher for treating dishes according to at least one cycle of operation, comprising: a tub at least partially defining a treating chamber for receiving the dishes; a rotatable sprayer providing a spray of liquid into the treating chamber and defining a rotational path as the rotatable sprayer is rotated; a drive system operably coupled to the rotatable sprayer to effect movement of the rotatable sprayer; a liquid recirculation system defining a recirculation flow path and selectively recirculating the sprayed liquid from the treating chamber to the rotatable sprayer; a sump assembly mounted in a lower portion of the tub and including a sensor enclosure projecting upwardly from a bottom of the sump assembly and terminating in a tip near the rotational path; a first sensor element located within the sensor enclosure and configured to sense at least a portion of the rotatable sprayer during rotation of the rotatable sprayer and outputting a signal indicative of the rotatable sprayer being sensed; and a controller configured to receive output from the first sensor element and control the drive system and the liquid recirculation system to rotate the rotatable sprayer while selectively supplying liquid to the rotatable sprayer; wherein the first sensor element provided in the sump assembly is fluidly isolated from the treating chamber.

2. The dishwasher of claim 1 wherein the sensor enclosure is water tight.

3. The dishwasher of claim 1 wherein the sensor enclosure is integrally formed with the sump assembly.

4. The dishwasher of claim 3 wherein the sensor enclosure is integrally molded with the sump assembly.

5. The dishwasher of claim 1 wherein the sensor enclosure is open on an end opposite the treating chamber and the first sensor element is introduced there through.

6. The dishwasher of claim 1, wherein the rotatable sprayer further comprises a second sensor element located on the rotatable sprayer.

7. The dishwasher of claim 6 wherein the second sensor is a magnet.

8. The dishwasher of claim 7 wherein the first sensor senses a magnetic field of the magnet.

9. The dishwasher of claim 1 wherein the drive system comprises a rotatable drive shaft operably coupled to the rotatable sprayer to effect movement of the rotatable sprayer.

10. The dishwasher of claim 9 wherein the drive system comprises a gear train coupling the rotatable drive shaft to the rotatable sprayer such that rotation of the rotatable drive shaft effects rotation of the rotatable sprayer via the gear train.

11. The dishwasher of claim 10, further comprising a motor operably coupled with the rotatable drive shaft to control the rotation of the rotatable drive shaft.

12. The dishwasher of claim 11 wherein a gear ratio of the gear train is such that the rotatable drive shaft and rotatable sprayer rotate at different speeds.

13. The dishwasher of claim 12 wherein the gear ratio is such that the rotatable sprayer rotates slower than the rotatable drive shaft.

14. The dishwasher of claim 1 wherein the controller is configured to calculate the location of the rotatable sprayer based on the output from the first sensor element.

* * * * *